US008217738B2

(12) United States Patent
Naito

(10) Patent No.: US 8,217,738 B2
(45) Date of Patent: Jul. 10, 2012

(54) ELECTROMECHANICAL ELEMENT, DRIVING METHOD OF THE ELECTROMECHANICAL ELEMENT AND ELECTRONIC EQUIPMENT PROVIDED WITH THE SAME

(75) Inventor: Yasuyuki Naito, Osaka (JP)

(73) Assignee: Panasonic Corporation, Osaka (JP)

( * ) Notice: Subject to any disclaimer, the term of this patent is extended or adjusted under 35 U.S.C. 154(b) by 644 days.

(21) Appl. No.: 12/121,233

(22) Filed: May 15, 2008

(65) Prior Publication Data

US 2008/0283374 A1 Nov. 20, 2008

(30) Foreign Application Priority Data

May 17, 2007 (JP) ..... 2007-131615

(51) Int. Cl.
*H01H 51/22* (2006.01)
*H01H 57/00* (2006.01)

(52) U.S. Cl. ..... 335/78; 200/181

(58) Field of Classification Search ..... 335/78; 200/181
See application file for complete search history.

(56) References Cited

U.S. PATENT DOCUMENTS

| | | | | |
|---|---|---|---|---|
| 5,638,946 | A * | 6/1997 | Zavracky | 200/181 |
| 6,046,659 | A * | 4/2000 | Loo et al. | 333/262 |
| 6,153,839 | A * | 11/2000 | Zavracky et al. | 200/181 |
| 6,608,268 | B1 * | 8/2003 | Goldsmith | 200/181 |
| 6,646,215 | B1 * | 11/2003 | Nelson | 200/181 |
| 6,657,525 | B1 * | 12/2003 | Dickens et al. | 335/78 |
| 6,787,438 | B1 * | 9/2004 | Nelson | 438/584 |
| 7,053,736 | B2 * | 5/2006 | Nelson | 335/70 |
| 7,242,273 | B2 | 7/2007 | Isobe et al. | |
| 7,352,266 | B2 * | 4/2008 | Chou | 335/78 |
| 7,373,717 | B2 * | 5/2008 | Lee et al. | 29/622 |
| 2003/0146079 | A1 * | 8/2003 | Goldsmith | 200/181 |
| 2003/0179056 | A1 * | 9/2003 | Wheeler et al. | 335/78 |
| 2003/0227361 | A1 * | 12/2003 | Dickens et al. | 335/78 |
| 2004/0040828 | A1 | 3/2004 | Ivanciw et al. | |
| 2004/0061579 | A1 * | 4/2004 | Nelson | 335/78 |
| 2004/0196124 | A1 | 10/2004 | Majumder et al. | |
| 2005/0062565 | A1 * | 3/2005 | Chou | 335/78 |
| 2005/0099252 | A1 * | 5/2005 | Isobe et al. | 335/78 |
| 2005/0183938 | A1 * | 8/2005 | Chou | 200/181 |
| 2007/0018761 | A1 * | 1/2007 | Yamanaka et al. | 335/78 |

FOREIGN PATENT DOCUMENTS

| | | | |
|---|---|---|---|
| JP | 2005-142982 | A | 6/2005 |
| JP | 2005-536854 | A | 12/2005 |
| JP | 2006-504243 | A | 2/2006 |
| JP | 2006-173043 | A | 6/2006 |
| WO | 01-88933 | A1 | 11/2001 |

OTHER PUBLICATIONS

Jeremy B. Muldavin & Gabriel M. Rebeiz "Inline Capacitive and DC-Contact MEMS Shunt Switches" IEEE Microwave and Wireless Components Letters. Aug. 2001. vol. 11, No. 8.

* cited by examiner

*Primary Examiner* — Elvin G Enad
*Assistant Examiner* — Alexander Talpalatskiy
(74) *Attorney, Agent, or Firm* — Pearne & Gordon LLP

(57) ABSTRACT

An electromechanical element includes a first electrode which is provided on a substrate, and a second electrode and a third electrode which are provided via a gap with respect to the first electrode. The first electrode contacts with the second electrode when an attracting force is applied between the first electrode and the third electrode. The first electrode has a bending portion.

13 Claims, 14 Drawing Sheets

| | MOVABLE ELECTRODE 101 | DRIVE ELECTRODE 103 |
|---|---|---|
| ON | HIGH | HIGH |
| OFF | LOW | HIGH |

| | MOVABLE ELECTRODE 101 | DRIVE ELECTRODE 110 | DRIVE ELECTRODE 111 |
|---|---|---|---|
| ON | HIGH | HIGH | HIGH |
| OFF | LOW | HIGH | HIGH |

| | MOVABLE ELECTRODE 101 | DRIVE ELECTRODE 110 | DRIVE ELECTRODE 111 |
|---|---|---|---|
| ON | HIGH | HIGH | HIGH |
| OFF | LOW | HIGH | HIGH |

ELECTROMECHANICAL ELEMENT, DRIVING METHOD OF THE ELECTROMECHANICAL ELEMENT AND ELECTRONIC EQUIPMENT PROVIDED WITH THE SAME

BACKGROUND

The present invention relates to an electromechanical element, a driving method of the electromechanical element and an electronic equipment provided with the electromechanical element.

An electromechanical element has many application fields such as wireless communication, light, acceleration sensor or biotechnology. Among others, the electromechanical element can be applied to a switch or filter for radio apparatus.

Along with the spread of the information communication equipment such as a wireless communication terminal, the frequency band used in the communication becomes increasingly more wide from hundreds MHz for portable telephone to a few GHz for wireless LAN. In a current situation, the terminals for supporting various communication methods are independently employed, but it is desired to realize a small wireless terminal capable of supporting various communication methods at one wireless terminal in the future. Although the number of passive components such as a switch contained in a housing of the terminal is expected to increase, it is desired to reduce the size of passive components.

In particular, the research and development of an RF-MEMS switch fabricated by an MEMS (Micro Electro Mechanical Systems) technology have been actively made. The RF-MEMS switch is the switch that mechanically switches the signal propagation path by moving a minute movable electrode. The advantage is that it has a small device size and excellent high frequency characteristics such as extremely low loss and high isolation. Since the switch can be manufactured through a process having good affinity with an RF-IC, it can be contained in the RF-IC. Therefore, the MEMS technology is expected as the technology greatly contributing to size reduction of a wireless portion.

The related RF-MEMS switch is a mechanical switch that switches the signal propagation path by contacting or separating a membrane or bar-like movable body, which is supported at both ends or only one end, with or from the electrode. Most of the driving force sources for the membrane or movable body employ electrostatic force, but other sources employing magnetic force have been already announced.

Conventionally, a minute switch as large as about several hundreds μm is well known as disclosed in a non-patent document 1. This switch is made by forming a signal line for passing the high frequency signal on the membrane and providing a control electrode directly below the signal line. If a dc potential is applied to the control electrode, the membrane is attracted toward the control electrode due to an electrostatic attracting force, and flexed to make contact with the ground electrode formed on the substrate, so that the signal line formed on the membrane is short-circuited, and the signal flowing through the signal line is attenuated and cut off. On the contrary, if the dc current is not applied to the control electrode, the membrane is not flexed, so that the signal flowing through the signal line on the membrane is not lost from the ground electrode but passes through the switch.

In propagating the signal by resistance coupling, it is required to form an excellent metal contact point that is stable and has low resistance. A technique for forming the excellent metal contact point owing to the effect (mechanical cleaning effect) of breaking through an oxide film on the surface of a fixed electrode by developing a pushing force for a movable electrode into the fixed electrode contacted by curving the movable electrode has been reported in patent document 1.

[Non-patent document 1] J. B. Muldavin and G. M. Rebeiz, IEEE Microwave Wireless Compon. Lett., vol. 11, pp. 334-336, August 2001

Patent document 1] WO01/88933

However, at present, when the excellent contact point of the electromechanical switch is formed, there occurs a sticking phenomenon (stiction) in which the contact point is sticky and difficult to release (separate). As a result, there is a problem that the reliability is decreased. Also, there is a problematical phenomenon that the contact point is deteriorated due to continuous driving or propagation of high power signal, thereby, the resistance value is increased.

SUMMARY

The invention has been achieved in the light of the above-mentioned problems, and it is an object of the invention to provide an electromechanical element with higher reliability in which the high speed response and low voltage driving are realized.

Thus, the present invention provides an electromechanical element, comprising:

a first electrode which is provided on a substrate; and a second electrode and a third electrode which are provided via a gap with respect to the first electrode, wherein the first electrode contacts with the second electrode when an attracting force is applied between the first electrode and the third electrode; and wherein the first electrode has a bending portion.

That is, the bending portion, or an uneven structure like V-shape, is provided on the first electrode serving as a movable electrode of the electromechanical element, and the first electrode is expanded or contracted by the third electrode serving as a drive electrode opposed to the uneven structure. In driving, the bending portion is expanded to increase a contracting force only when releasing the contact point. That is, the uneven structure is contracted only when releasing the contact point. In this way, the first electrode includes the bending portion, namely, a proximity portion proximate to the second electrode or the third electrode. Thereby, when the first electrode is pushed to the second electrode in the contacting process, a pushing force is increased by the bending portion, or when the pushing force is released, the first electrode is displaced in the horizontal direction with respect to the substrate to pull back due to a spring force of the bending portion to easily release the contact point.

In this way, since the first electrode is provided with the bending portion, the response speed is decided by the spring force before the contact state due to expansion and contraction of the spring with the bending portion. When the spring force of the bending portion is high, a high voltage is required, but the first electrode can easily make contact due to existence of the bending portion. After pushing the first electrode with respect to the second electrode, the spring force of the bending portion is increased due to the pushing force, so that the contact point is slid in the horizontal direction to release the contact point. In this way, the contact point is slid in the horizontal direction to develop a force for releasing the contact point in the shearing direction so that the contact point is easily separated. It is possible to easily make good contact or break contact between the electrodes of the electromechanical element, thereby avoiding a sticking phenomenon (stiction) of the contact point.

With this constitution, it is possible to realize the electromechanical element with high reliability that was conventionally difficult to realize, and an electrical machinery and apparatus using the electromechanical element.

Preferably, the bending portion is provided at a leading end of the first electrode so as to come closer to the second electrode.

By the above configuration, the contact point between the first electrode and the second electrode can be displaced on the second electrode.

Preferably, the bending portion is provided in an intermediate part of the first electrode.

By the above configuration, the first electrode is expandable and contractible.

Preferably, the bending portion has a portion proximate to the third electrode.

By the above configuration, the expansion and contraction of the first electrode can be controlled by the third electrode.

According to the present invention, there is also provided an electromechanical element formed on a substrate, comprising:

a first electrode which is provided on a post portion; and a second electrode and a third electrode which are provided via a gap with respect to the first electrode, wherein the first electrode contacts with the second electrode when an attracting force is applied between the first electrode and the third electrode; and wherein the first electrode has an uneven configuration.

Preferably, the first electrode has a curved configuration. The curved configuration does not limit to the V-shape, and may have a gentle curved shape since the gentle curved shape also has the same spring feature as the V-shape and is effective.

Preferably, a contact point between the first electrode and the second electrode is displaced in a horizontal direction with respect to the substrate.

By the above configuration, it is possible to increase a pushing force of the first electrode to the second electrode by the spring force with the uneven structure or the curved configuration in addition to a driving force. Also, it is possible to slide the contact point in the horizontal direction, after once contacting, achieving the effect of breaking through the oxide film on the surface of the fixed electrode. When the contact point is deteriorated due to continuous driving, fatigue or a change with the passage of time, it is possible to form the excellent contact point stably. Also, it is possible to increase a separating force in the shearing direction. Since the contact point is slid, it is possible to easily release the contact point owing to the separating force in the shearing direction. It is possible to avoid stiction and realize stable driving. Since the spring of the uneven structure is provided on the movable electrode, it is possible to reduce the spring force of the entire movable electrode, and realize high speed response and lower driving voltage.

Preferably, the uneven structure is provided on the first electrode in the vertical direction with respect to the substrate.

By the above configuration, a distance between the first and second electrodes becomes closer and the responsibility of the switch is increased.

Preferably, the bending portion has a V shape protruding toward the third electrode.

By the above configuration, it is possible to easily increase a corresponding area between the uneven structure and the third electrode (a drive electrode) on the manufacturing, and give an electrostatic force required to expand the spring with the uneven structure.

Preferably, the bending portion is a notch formed on a surface of the first electrode facing to the third electrode.

By the above configuration, the notch has the similar spring force as the bending portion. Also, the notch is easily form on the manufacturing. Further, it is possible to easily increase a corresponding area between the uneven structure (the notch) and the third electrode (the drive electrode), and give an electrostatic force required to expand the spring with the uneven structure.

Preferably, the first electrode has a plurality of the bending portions.

By the above configuration, the number of spring of the uneven structure is increased, and the distance of the expanding or extracting of the first electrode can be increased. Also, the pushing force of the movable electrode (the first electrode) to the signal electrode (the second electrode) and the effect of separating the movable electrode from the signal electrode can be enhanced. Also, since the springs of the uneven structure are provided on the movable electrode, it is possible to reduce the spring force of the entire movable electrode, and realize high speed response and lower driving voltage.

Preferably, a plurality of the third electrodes are provided. Also, the third electrodes are disposed so as to sandwich a space opposite to the bending portion.

By the above configurations, the uneven structure can be inserted between the drive electrodes. It is possible to easily increase the corresponding area between the uneven structure and the drive electrode on the manufacturing, and give an electrostatic force required to expand the spring with the uneven structure. Also, it is possible to avoid the contact between the uneven structure and the drive electrode and avoid occurrence of stiction.

Preferably, the first electrode is expanded or contracted when the first electrode is separated from the second electrode.

By the above configuration, it is possible to achieve the effect of higher reliability due to the curvature structure and the uneven structure using the same simple control signal as where the curvature structure or the uneven structure is not provided. Also, it is possible to increase a contracting force by once expanding the spring of the curvature structure or uneven structure, and easily part the contact point between the movable electrode and the signal electrode.

According to the present invention, there is also provided a driving method of an electromechanical element including a first electrode which has a bending portion and is provided on a substrate, and a second electrode and a third electrode which are provided via a gap with respect to the first electrode, the driving method comprising:

contacting the first electrode with the second electrode by applying an attracting force between the first electrode and the third electrode; and releasing a contact state of the first electrode with the second electrode by an expanding or contracting force of the bending portion of the first electrode.

By the above method, the electromechanical switch having a high speed response and a lower driving voltage can be provided.

Preferably, in the contacting process, the first electrode is displaced on the second electrode at a contact position between the first electrode and the second electrode by an expanding or contracting force of the bending portion.

By the above method, it is possible to slide the contact point in the horizontal direction, achieving the effect of breaking through the oxide film on the surface of the second electrode. When the contact point is deteriorated due to continuous driving, fatigue or a change with the passage of time, it is possible to form the excellent contact point stably. Since the spring of the uneven structure is provided on the movable electrode, it is possible to reduce the spring force of the entire movable electrode, and realize high speed response and lower driving voltage.

Preferably, the releasing process, the first electrode is displaced on the second electrode at a contact position between the first electrode and the second electrode by an expanding or contracting force of the bending portion.

By the above method, it is possible to increase a separating force of the first electrode from the second electrode by increasing the restoring force in addition to the pushing force. Since the contact point is slid, it is possible to easily release the contact point owing to the separating force in the shearing direction. Also, it is possible to avoid stiction and realize stable driving.

Preferably, in the releasing process, an attracting force is instantaneously applied between the first electrode and the third electrode before the contact state of the first electrode with the second electrode is released.

By the above method, since the greater attracting force is instantaneously applied between the first electrode and the third electrode just before the contact state of the first electrode with the second electrode is released, the contact point is slid. Therefore, it is possible to easily release the contact point owing to the separating force in the shearing direction.

Preferably, in the releasing process, the contact state of the first electrode with the second electrode is released by a restoring force of the bending portion.

By the above method, it is possible to increase a force for separating the contact point.

As described above, with the invention, it is possible to realize the electromechanical element with high reliability for a switching element having low power driving and high speed response that was conventionally difficult to realize, and the electrical machinery and apparatus using the electromechanical element.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

The embodiments of the present invention will be described below with reference to the drawings.

First Embodiment

Figure 1:
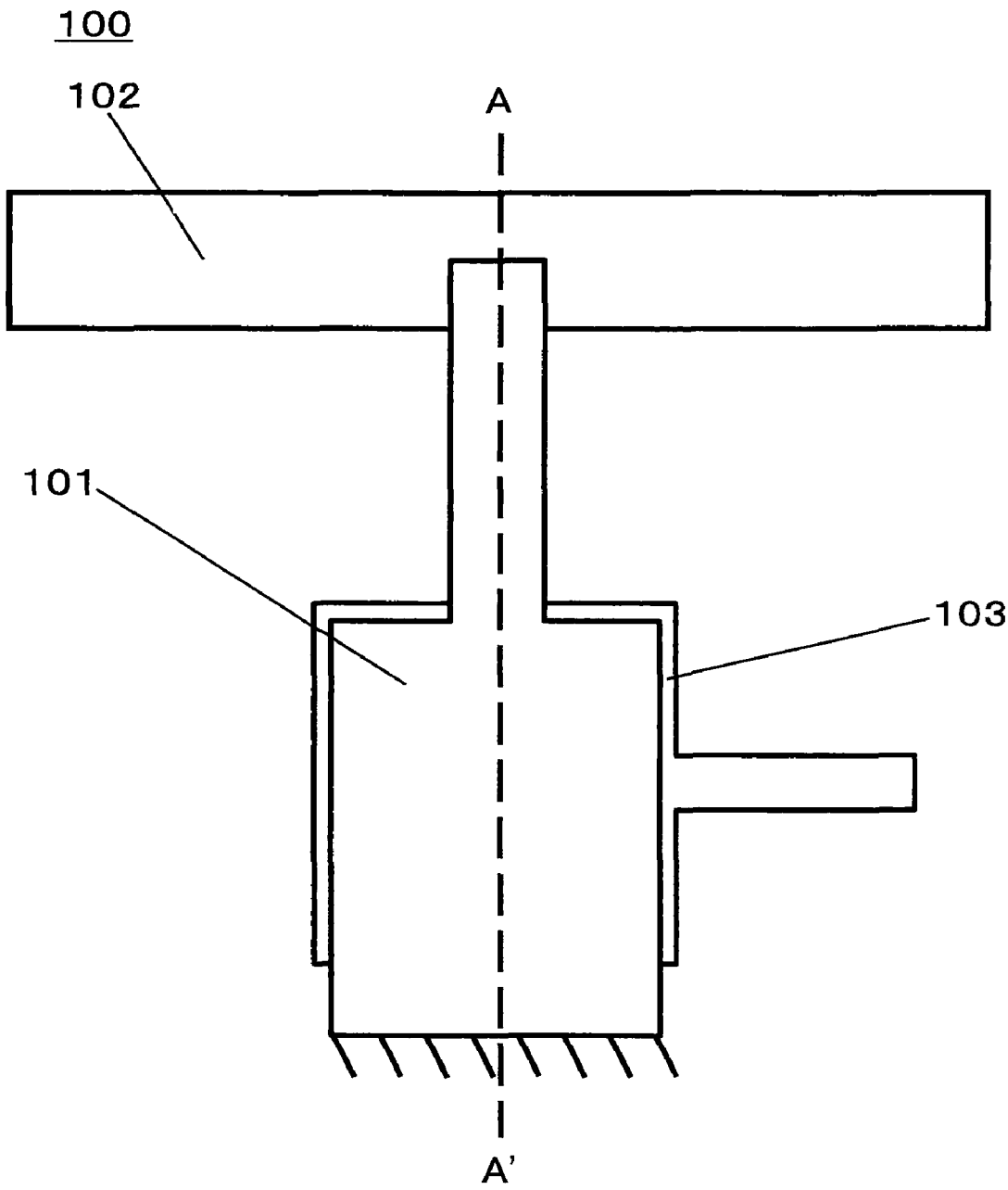
FIG. 1 is an upper view showing the constitution of an electromechanical switch according to a first embodiment of the present invention.
Figure 2A:
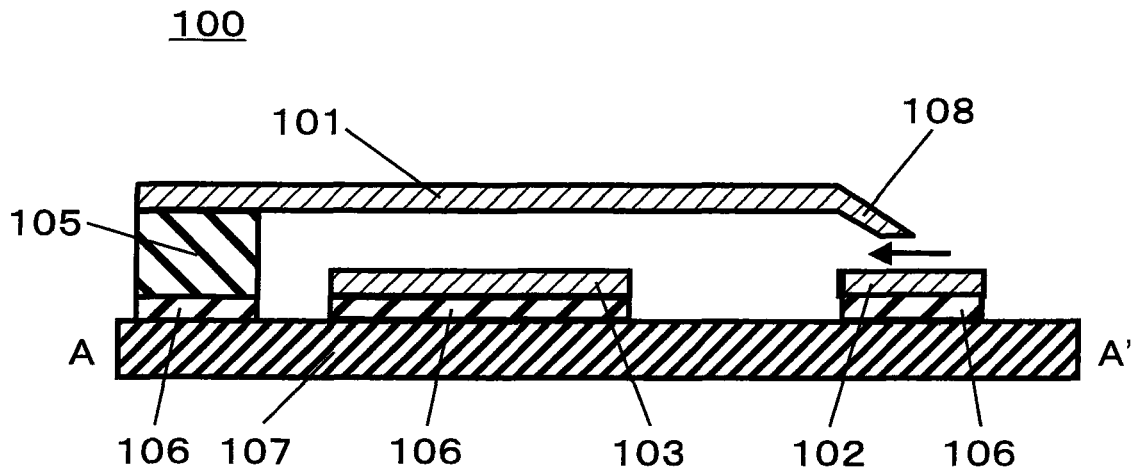
FIG. 2A is a cross-sectional view showing the constitution of the electromechanical switch in ON state, taken along the line A-A' in FIG. 1.
Figure 2B:
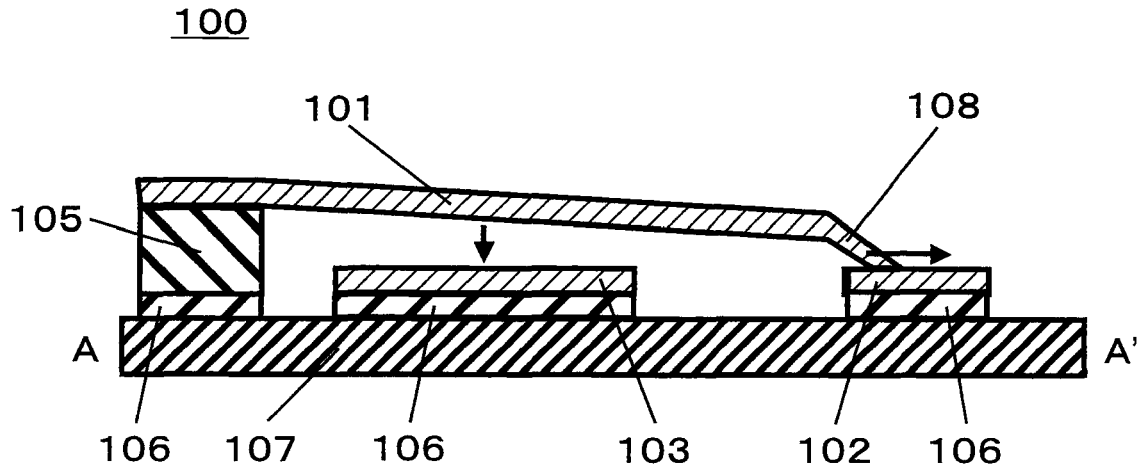
FIG. 2B is a side cross-sectional view showing the constitution of the electromechanical switch in OFF state, taken along the line A-A' in FIG. 1.

FIG. 1A is an upper view showing the constitution of an electromechanical switch according to a first embodiment of the invention. FIG. 2A is a side cross-sectional view showing the constitution of the electromechanical switch in ON state, taken along the line A-A' in FIG. 1, and FIG. 2B is a side cross-sectional view showing the constitution of the electromechanical switch in OFF state, taken along the line A-A' in FIG. 1.

The electromechanical switch 100 as shown in FIGS. 1 and 2 has a feature that a bending portion 108 is formed at front end of a movable electrode 101 serving as a first electrode. Herein, the electromechanical switch 100 includes an insulating layer 106 that becomes a layer insulation film on a substrate 107, a movable electrode 101 serving as the first electrode, which is a cantilevered beam, disposed at a position contactable with a signal electrode 102 serving as a second electrode, the signal electrode 102 that becomes a signal transmission line formed to be opposed to the movable electrode 101 via a gap, a drive electrode 103 serving as a third electrode disposed at a position opposite to the movable electrode 101, and an insulating layer 105 that serves as a post portion.

Next, a switching mechanism in the electromechanical switch 100 will be described below.

When the electromechanical switch 100 is in an ON state, the movable electrode 101 is at an initial position without displacement, and out of contact with the signal electrode 102. In this state, no signal conducting path is formed between the movable electrode 101 and the signal electrode 102. The electromechanical switch has a small electrostatic capacity via an air gap between the movable electrode 101 and the signal electrode 102. Therefore, even if a high frequency signal intends to propagate, the signal can not be propagated from the signal electrode 102 to the movable electrode 101 due to a high impedance state with alternating current. As a result, the signal inputted from one end of the signal electrode 102 is passed to the opposite end of the signal electrode 102 and outputted.

On the other hand, the when electromechanical switch 100 is in an OFF state, a voltage is applied between the movable electrode 101 and the drive electrode 103 so that the movable electrode 101 is attracted to the drive electrode 103 due to an electrostatic force. Therefore, the movable electrode 101 is connected to the signal electrode 102. At this time, since the bending portion 108 is formed at the front end of the movable electrode 101, when the movable electrode 101 is pushed onto the signal electrode 102, the bending portion 108 serving as a spring is pushed, thereby increasing a pushing force with a spring force of the bending portion in addition to a driving force. Also, the contact point of the bending portion 108 at the signal electrode 102 can be slid in the horizontal direction. As a result, the effect of breaking through an oxide film on the surface of the signal electrode 102 is produced. Accordingly, even when the contact point is deteriorated due to continuous driving, fatigue or a change with the passage of time of the movable electrode 101, the excellent contact point can be provided stably. In this way, the metal contact point is formed between the movable electrode 101 and the signal electrode 102 to form a signal conducting path. The signal can be propagated from the signal electrode 102 to the movable electrode 101. Therefore, the signal inputted into one end of the signal electrode 102 is propagated via the movable electrode 101 to the ground, and is not outputted to the opposite end of the signal electrode 102.

When the electromechanical switch 100 is turned from OFF state to ON state, the movable electrode 101 and the drive electrode 103 are made at the same potential to cut off the electrostatic force therebetween, whereby a force for returning to the original initial state is generated on the movable electrode 101 due to a spring force of the movable electrode 101. That is, if the contact point is formed, a spring in the bending portion (curvature structure) is expanded, whereby when the contact point is separated, the spring in the bending portion is contracted, and a force for separating the contact point can be increased. Since the contact point is slid, a separating force in the shearing direction is added to the contact point so that the contact point can be released more easily. It is possible to avoid stiction and realize the stable driving. In the above way, it is possible to switch over to the ON state with the spring force from the OFF state.

Figure 13A:
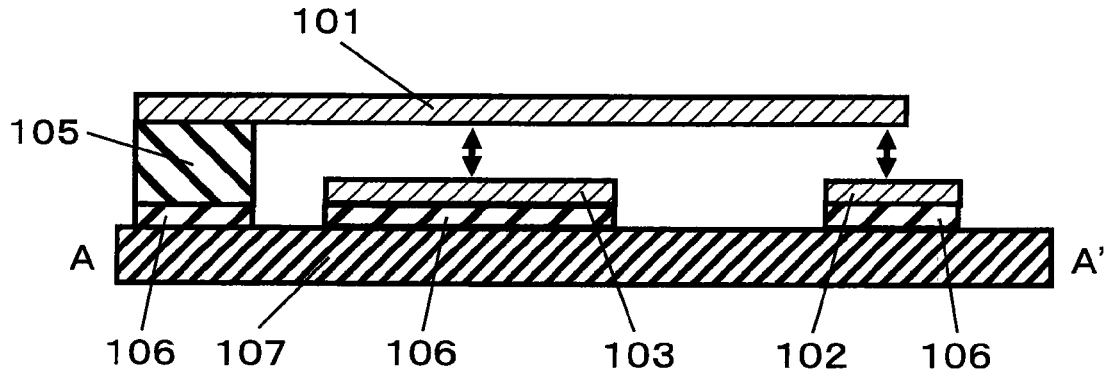
FIG. 13A is a side cross-sectional view showing the constitution of the related electromechanical switch in ON state.
Figure 13B:
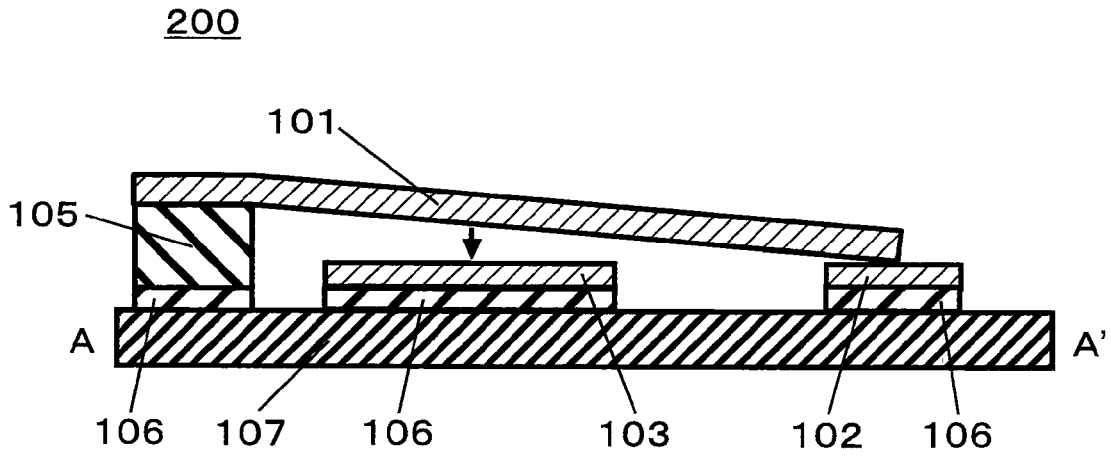
FIG. 13B is a side cross-sectional view showing the constitution of the related electromechanical switch in OFF state.
Figure 14:
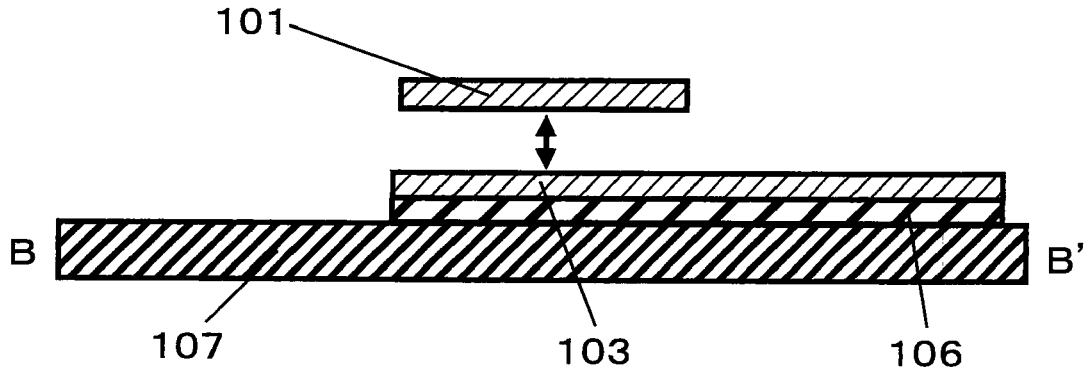
FIG. 14 is a view showing the constitution of the related electromechanical switch.

For comparison, the related movable electrodes 101 without providing the bending portion 108 are shown in the cross-sectional views of FIGS. 13A and 13B, and FIG. 14. From their comparison, it will be found that with the electromechanical element according to the embodiment of the invention, a low voltage, high speed driving is possible due to the existence of the bending portion 108.

Although the movable electrode contacts the upper surface of the signal electrode in this embodiment as described above, the movable electrode may contact the side face of the signal electrode.

Although a switch (shunt type switch) in which the variable capacity is connected in parallel to the transmission line on an equivalent circuit of the electromechanical switch and then connected to the ground has been described above in this embodiment, the invention is also applicable to a switch (series type switch) in which the variable capacity is connected in series with the transmission line. In the series type switch, the position of the movable electrode in the ON or OFF state is reversed from the shunt type switch. When the electromechanical switch is in the OFF state, there is no contact with the movable electrode. Therefore, a signal inputted into one signal electrode is not propagated to the other signal electrode, so that the signal is not outputted. Conversely, when the electromechanical switch is in the ON state, the movable electrode is contacted to the signal electrode, so that the signal is propagated through the movable electrode and outputted. In this way, although the signal propagation path is opened or closed in the series type switch, the electromechanical switch of the invention may be also applicable to the series type electromechanical switch.

Also, although a resistance coupling type switch in which the movable electrode is directly connected to the signal electrode is described above this embodiment, the invention may be applicable to a capacity coupling type switch in which an insulation film is formed on at least one of the surface of the movable electrode and the surface of the signal electrode, and an ac signal is coupled with electrostatic capacity via the insulation film. In this case, the drive electrode for driving the movable electrode is not required, whereby the electromechanical switch can be driven by applying an electrostatic force between the movable electrode and the signal electrode.

Also, although the movable electrode of the cantilever type is described in this embodiment, the movable electrode supported at both ends thereof may be applied.

In this way, with the electromechanical switch 100, it is possible to realize the electromechanical switch with high reliability that was conventionally difficult to realize, and an electrical machinery and apparatus using the electromechanical switch.

Second Embodiment

Figure 3A:
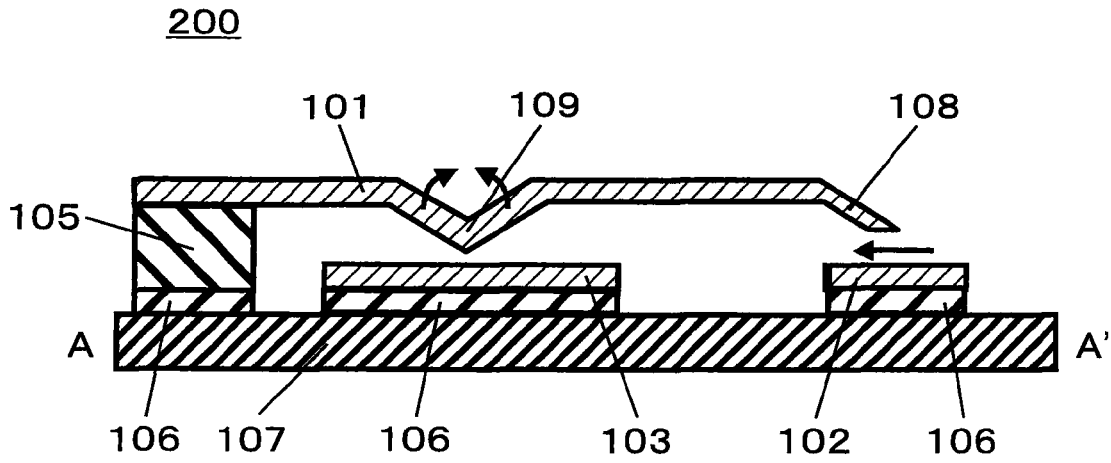
FIG. 3A is a side cross-sectional view showing the constitution of an electromechanical switch in ON state according to a second embodiment of the invention.
Figure 3B:
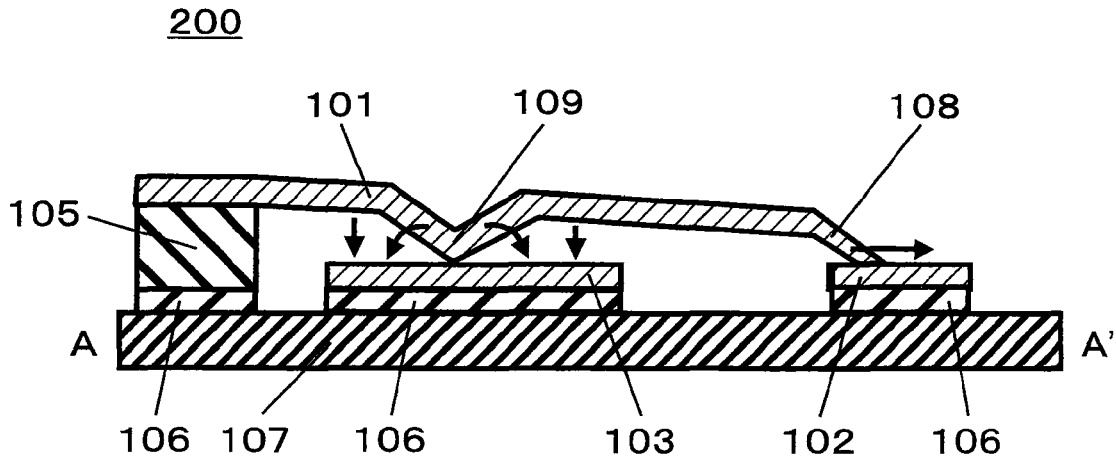
FIG. 3B is a side cross-sectional view showing the constitution of the electromechanical switch in OFF state.

FIG. 3A is a side cross-sectional view showing the constitution of an electromechanical switch in ON state according to the second embodiment of the invention, and FIG. 3B is a side cross-sectional view showing the constitution of the electromechanical switch in OFF state.

In the electromechanical switch 200 as shown in FIGS. 3A and 3B, in addition to the constitution of the bending portion 108 at the front end of the movable electrode 101 according to the first embodiment, an intermediate bending portion 109 is provided in an intermediate part of the movable electrode 101. An insulation film is formed on at least the surface of the movable electrode 101 opposed to the drive electrode 103 and the surface of the drive electrode 103 opposed to the movable electrode 101.

With this configuration, when the movable electrode 101 is pulled into the drive electrode 103, the bending portion 109 having a uneven structure and serving as a spring is pushed to expand the uneven structure. As a result, a pushing force can be increased because a spring force of the uneven structure is added to a driving force. Also, the contact point can be slid in the horizontal direction, such that the effect of breaking through an oxide film on the surface of the fixed electrode is produced. Even when the contact point is deteriorated due to continuous driving, fatigue or a change with the passage of time, the excellent contact point can be realized stably.

Conventionally, when an excellent contact point was formed, there was a phenomenon (stiction) that the contact point is difficult to separate from other corresponding point.

However, with the above configuration, since the contact point is formed in a state that the spring of the uneven structure by the bending portion 108 and the intermediate bending portion 109 is expanded, whereby in releasing the contact point, two springs formed by the bending portion 108 and the intermediate bending portion 109 are contracted so that a force for separating the contact point is increased. Since the contact point is slid, a releasing force is applied to the contact point in the shearing direction. Therefore, the contact point can be easily released. It is possible to avoid stiction and realize the stable driving.

Also, when the uneven structure has a V shape, the corresponding area of the movable electrode 101 with respect to the drive electrode can be easily increased on the manufacturing, thereby giving an electrostatic force required to expand the spring of the uneven structure.

Since the spring of the uneven structure is provided on the movable electrode, the spring force of the entire movable electrode can be reduced, whereby the high speed response and lower drive voltage can be achieved.

Although the movable electrode contacts with the drive electrode in this embodiment as described above, the electromagnetic switch in which the movable electrode does not contact with the drive electrode can be realized.

Also, although the uneven structure has the V shape in this embodiment as described above, the structure may have a rectangular shape.

Also, although the movable electrode has a curvature structure in this embodiment as described above, the structure may not have the curvature structure.

In this embodiment, with the electromechanical switch 200, it is possible to realize the electromechanical switch with high reliability that was conventionally difficult to realize, and an electronic equipment provided with the electromechanical switch.

Third Embodiment

Figure 4:
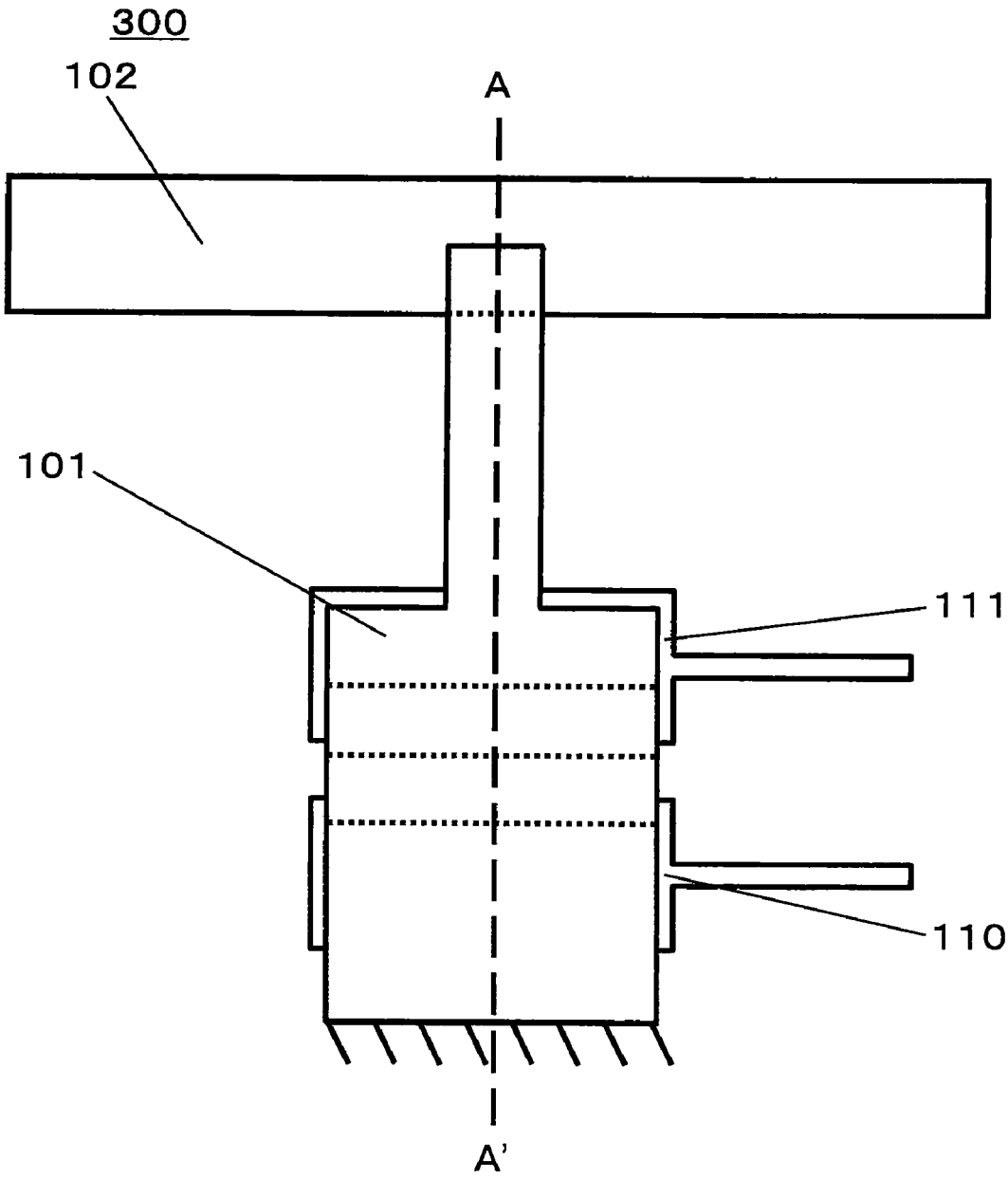
FIG. 4 is an upper view showing the constitution of an electromechanical switch according to a third embodiment of the invention.
Figure 5A:
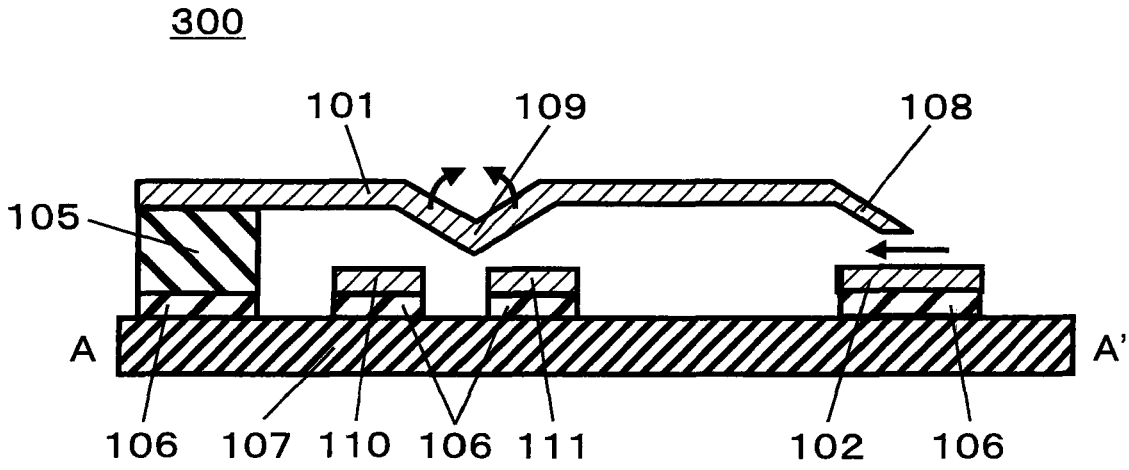
FIG. 5A is a cross-sectional view showing the constitution of the electromechanical switch in ON state, taken along the line A-A' in FIG. 4.

FIG. 4 is an upper view showing the constitution of an electromechanical switch according to a third embodiment of the invention. FIG. 5A is a side cross-sectional view showing the constitution of the electromechanical switch in ON state, taken along the line A-A' in FIG. 4, and FIG. 5B is a side cross-sectional view showing the constitution of the electromechanical switch in OFF state, taken along the line A-A' in FIG. 4.

Figure 5B:
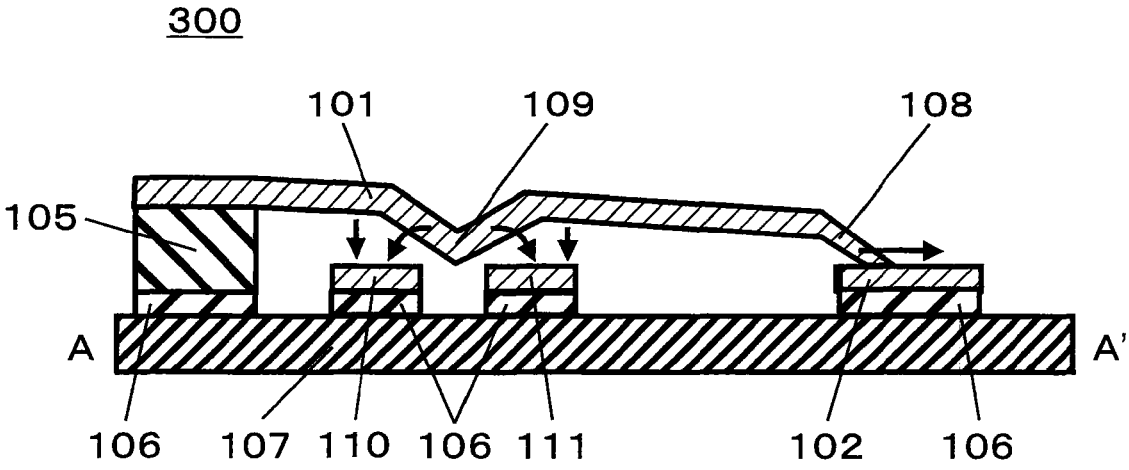
FIG. 5B is a side cross-sectional view showing the constitution of the electromechanical switch in OFF state, taken along the line A-A' in FIG. 4.

In the electromechanical switch 300 as shown in FIGS. 5A and 5B, two drive electrodes 110 and 111 serving as the third electrodes are provided at the positions opposite to the intermediate bending portion 109 formed on the movable electrode 101.

With this constitution, the intermediate bending portion 109 can be inserted between the drive electrodes 110 and 111. It is possible to increase the corresponding area between the intermediate bending portion 109 and the drive electrodes 110 and 111 easily on the manufacturing, thereby giving an electrostatic force required to expand the springs of the intermediate bending portion 109 and the bending portion 108 at the front end. Also, it is possible to avoid contact between the intermediate bending portion 109 and the drive electrodes 110 and 111 and avoid occurrence of stiction.

Figure 6:
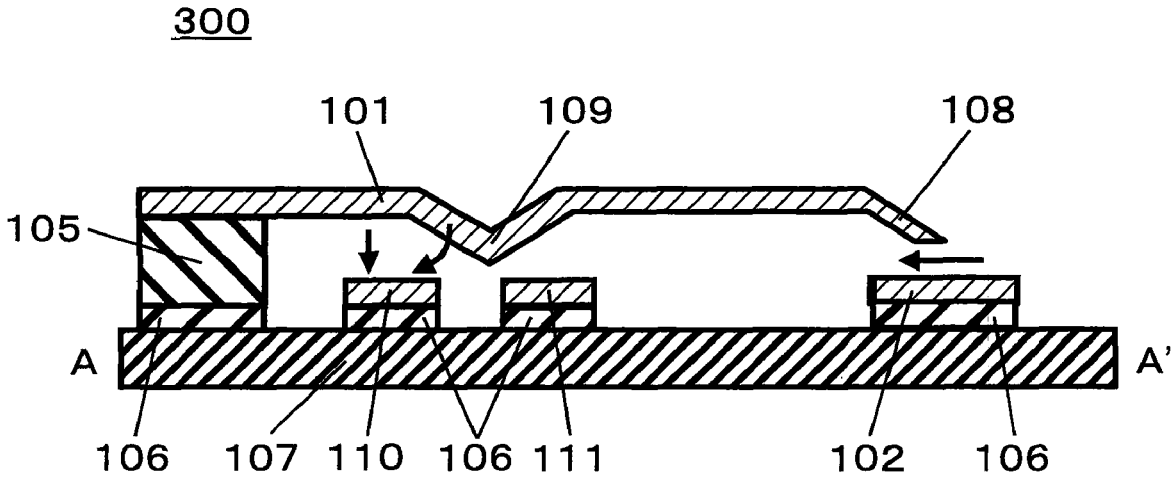
FIG. 6 is a side cross-sectional view showing a modification of FIGS. 5A and 5B.
Figures 12A, 12B:
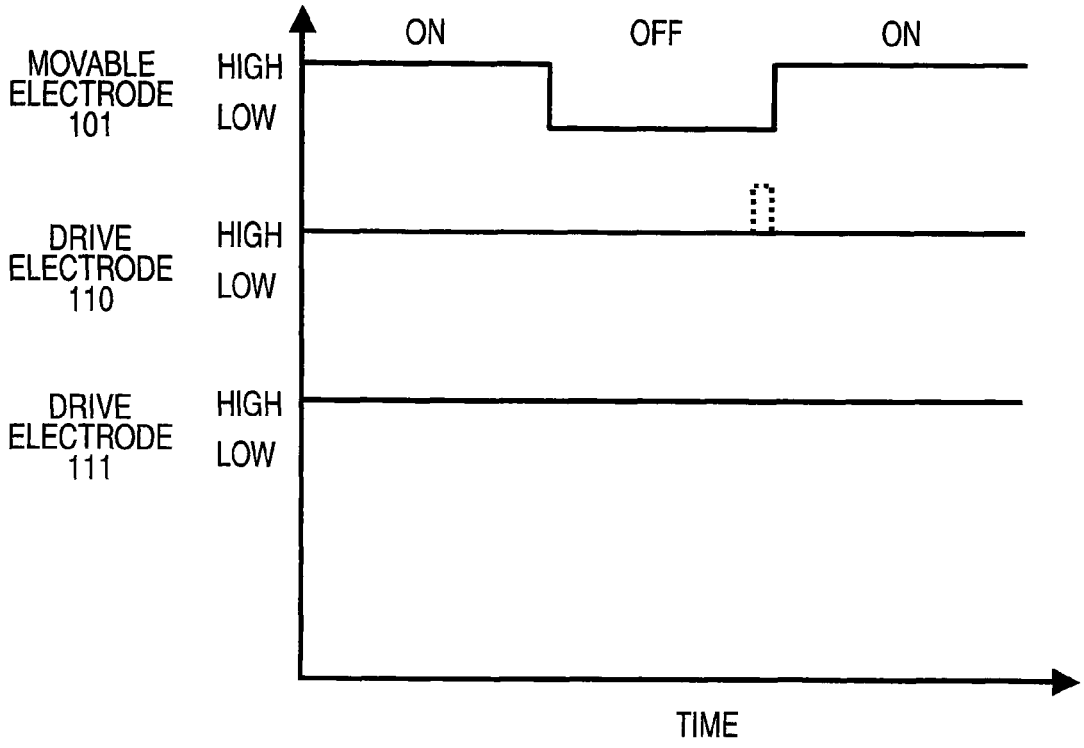
FIG. 12A is a table showing the control signals for an electromechanical switch according to a modification of the eight embodiment of the invention.
FIG. 12B is a graph showing the control signals for the electromechanical switch.

Although a pulling method for pulling the movable electrode with the drive electrodes 110 and 111 arranged at both sides of the intermediate bending portion 109 of the uneven structure is described above in this embodiment, it is possible to increase an electrostatic force with the drive electrode arranged on the one side to pull the movable electrode toward the one side, as shown in FIG. 6. When the movable electrode is pulled in the reverse direction to the signal electrode 102 by the drive electrode 110, the contact point between the movable electrode 101 and the signal electrode 102 is easily released by sliding the contact point. Although this driving method will be described later, the potential of the drive electrode 110 is increased immediately before turning ON the switch to apply a greater driving force between the movable electrode 101 and the drive electrode 110. The contracting force of the movable electrode 101 is increased by once expanding the springs of the intermediate bending portion 109 and the bending portion 108, as shown in FIG. 12B. This can be implemented by increasing a control signal of the drive electrode 110 instantaneously. With this driving method, the contact point between the movable electrode and the signal electrode can be easily released.

In this way, with the electromechanical switch 300, it is possible to realize the electromechanical switch with high reliability that was conventionally difficult to realize, and an electrical machinery and apparatus using the electromechanical switch.

Fourth Embodiment

Figure 7A:
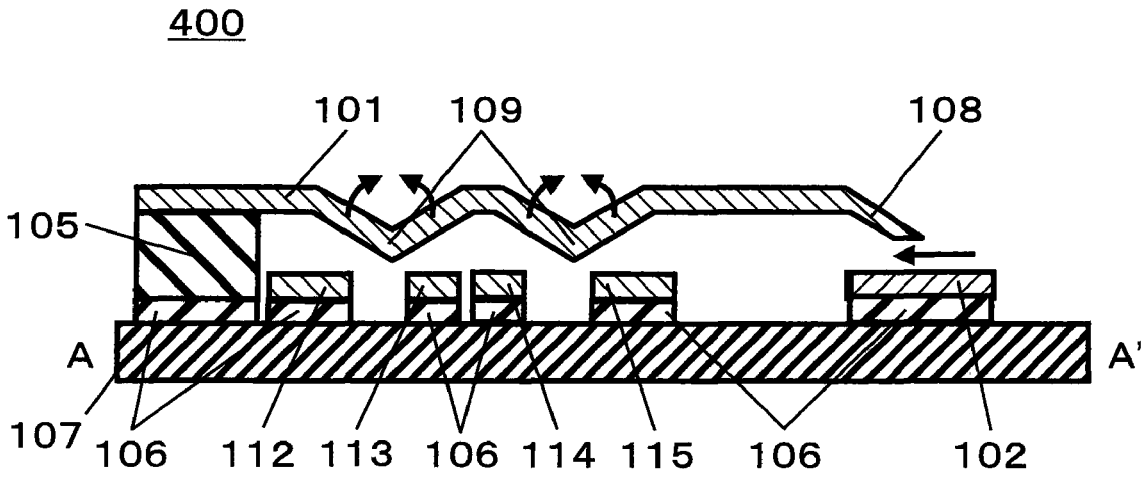
FIG. 7A is a side cross-sectional view showing the constitution of an electromechanical switch in ON state according to a fourth embodiment of the invention.
Figure 7B:
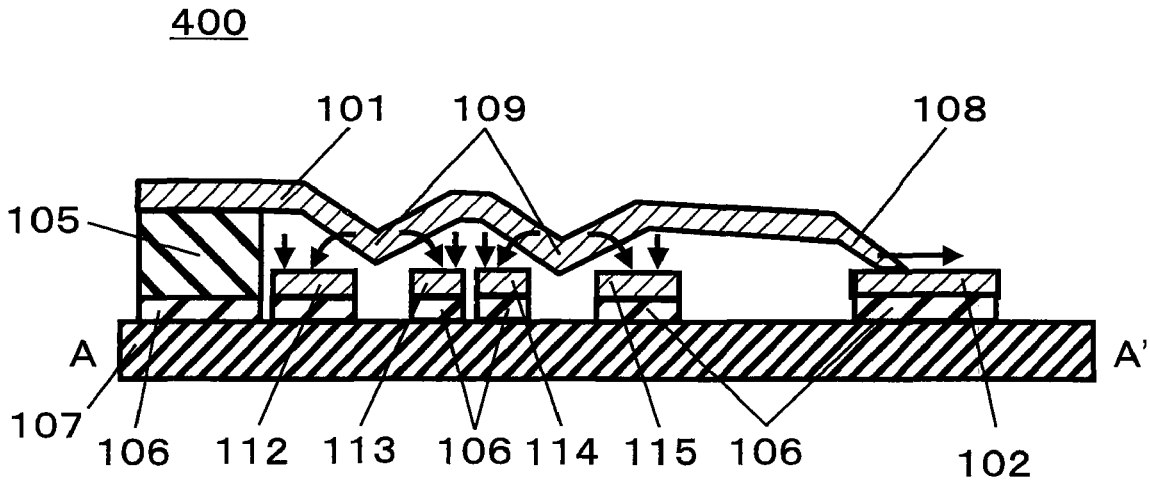
FIG. 7B is a side cross-sectional view showing the constitution of the electromechanical switch in OFF state.

FIG. 7A is a side cross-sectional view showing the constitution of an electromechanical switch in ON state according to a fourth embodiment of the invention, and FIG. 7B is a side cross-sectional view showing the constitution of the electromechanical switch in OFF state.

In the electromechanical switch 400 as shown in FIGS. 7A and 7B, a plurality of intermediate bending portions 109 are provided, in addition to the bending portion 108, on the movable electrode 101, and four drive electrodes 112, 113, 114 and 115 serving as the third electrodes are provided at the positions corresponding to the plurality of intermediate bending portions 109.

With this configuration, since the number of springs for the intermediate bending portions 109 is increased, it is possible to increase the distance that the intermediate bending portions 109 are expanded and contracted. There is a greater effect of pushing or releasing the movable electrode 101 with respect to the signal electrode 102.

Since the plurality of springs of the uneven structure are provided on the movable electrode 101, the spring force of the entire movable electrode 101 can be reduced, whereby the high speed response and lower driving voltage can be achieved.

In this way, with the electromechanical switch 400, it is possible to realize the electromechanical switch with high reliability that was conventionally difficult to realize, and an electrical machinery and apparatus using the electromechanical switch.

Fifth Embodiment

Figure 8A:
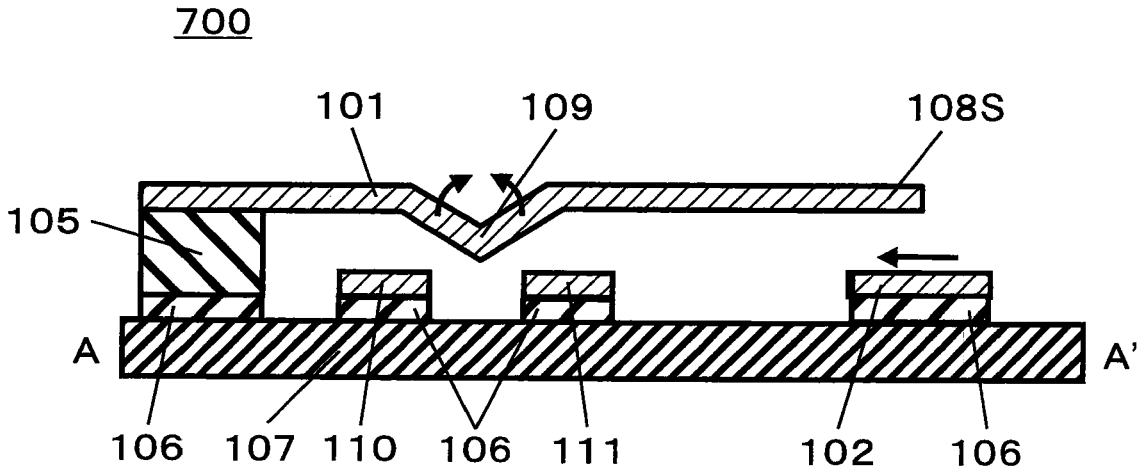
FIG. 8A is a side cross-sectional view showing the constitution of an electromechanical switch in ON state according to a fifth embodiment of the invention.
Figure 8B:
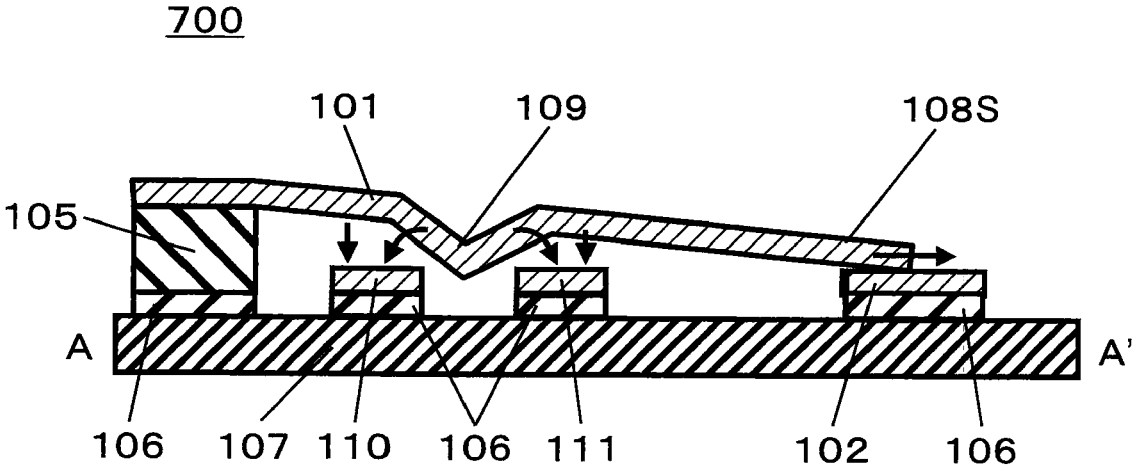
FIG. 8B is a side cross-sectional view showing the constitution of the electromechanical switch in OFF state.

FIG. 8A is a side cross-sectional view showing the modified constitution of an electromechanical switch in ON state, taken along the line A-A' in FIG. 4, according to a fifth embodiment of the invention, and FIG. 8B is a side cross-sectional view showing the modified constitution of the electromechanical switch in OFF state, taken along the line A-A' in FIG. 4. A different point between the electromechanical switch of this embodiment and the electromechanical switch of the fourth embodiment is that the bending portion is not provided at the front end of the movable electrode 101 and a linear front end portion 108S is provided on the movable electrode 101.

In the electromechanical switch 700 as shown in FIGS. 8A and 8B, like the electromechanical switch 300 as shown in FIGS. 5A and 5B, two drive electrodes 110 and 111 serving as the third electrodes are provided at the positions opposite to the intermediate bending portion 109 formed on the movable electrode 101.

With this constitution, the intermediate bending portion 109 can be inserted between the drive electrodes 110 and 111. It is possible to increase the corresponding area between the intermediate bending portion 109 and the drive electrodes 110 and 111 easily on the manufacturing, thereby giving an electrostatic force required to expand the springs of the intermediate bending portion 109. Also, it is possible to avoid contact between the intermediate bending portion 109 and the drive electrodes 110 and 111 and avoid occurrence of stiction.

In this way, with the electromechanical switch 700, it is possible to realize the electromechanical switch with high reliability that was conventionally difficult to realize, and an electrical machinery and apparatus using the electromechanical switch.

Sixth Embodiment

Figure 9A:
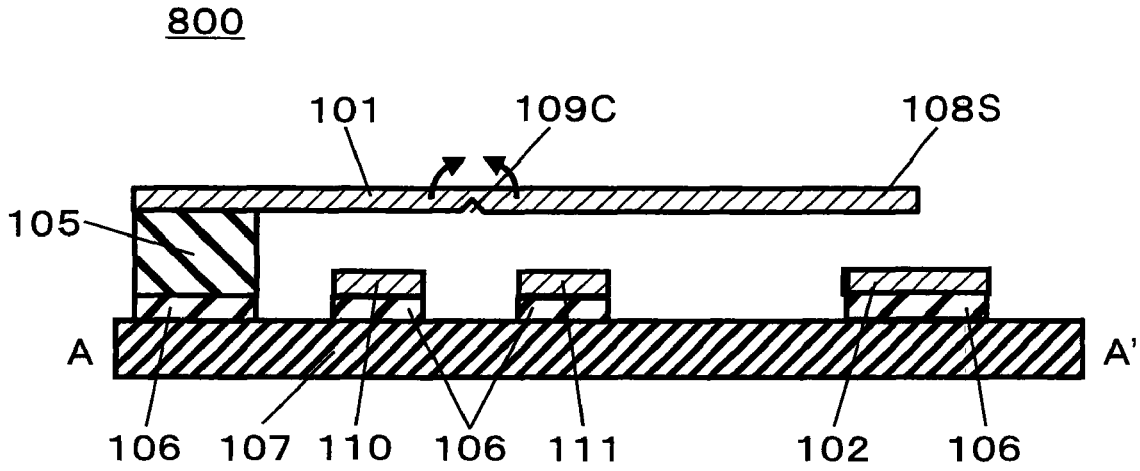
FIG. 9A is a side cross-sectional view showing the constitution of an electromechanical switch in OFF state according to a sixth embodiment of the invention.
Figure 9B:
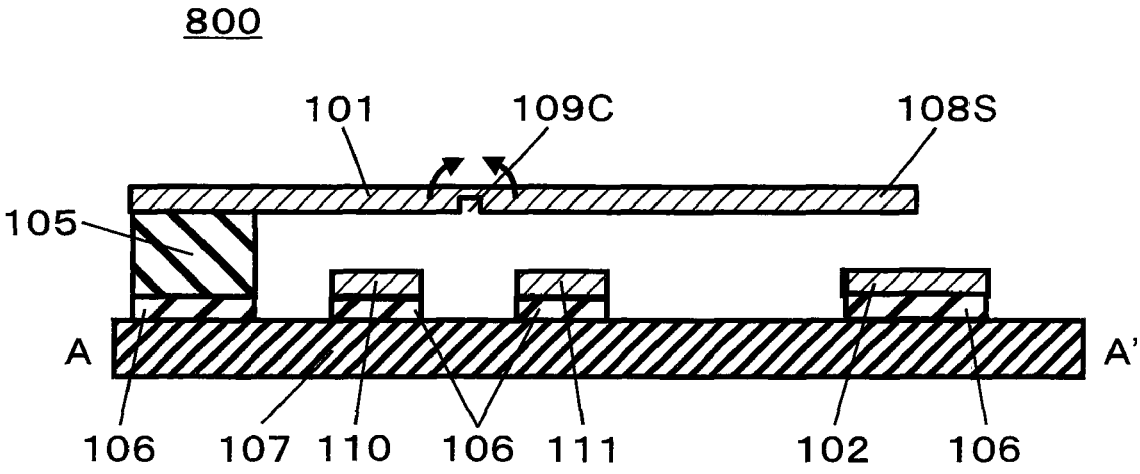
FIG. 9B is a side cross-sectional view showing the constitution of the electromechanical switch in OFF state.

FIG. 9A is a side cross-sectional view showing the modified constitution of an electromechanical switch in OFF state, taken along the line A-A' in FIG. 4, according to a sixth embodiment of the invention, and FIG. 9B is a side cross-sectional view showing the further modified constitution of the electromechanical switch in OFF state, taken along the line A-A' in FIG. 4. A different point between the electromechanical switch of this embodiment and the electromechanical switch of the fifth embodiment is that a slit portion 109C is formed over the entire width of a beam serving as the movable electrode 101, instead of the intermediate bending portion 109. Also, the movable electrode 101 has a spring force due to the existence of this slit portion 109C. This electromechanical switch is the same as the electromechanical switch of the sixth embodiment in that the bending portion is not provided at the front end but the linear front end portion 108S is provided. A different point between FIG. 9A and FIG. 9B is the shape of the slit portion 109C, in which the notch has a cross section of V shape in FIG. 9A, while the notch has a cross section of U-shape in FIG. 9B. In the notch having the cross section of V-shape, a notch shape can be formed by etching a shallow backing sacrifice layer, and realized through a simple manufacturing process. In FIG. 9B, the notch has a cross section of U-shape. In the notch having the cross section of U-shape, when a plurality of notch angles are provided, it is possible to disperse a stress concentrated at the angles, and the strength is enhanced.

In the electromechanical switch 800 as shown in FIGS. 9A and 9B, like the electromechanical switches 300 and 700 as shown in FIGS. 5A, 5B, 8A and 8B, two drive electrodes 110 and 111 serving as the third electrodes are provided at the positions opposite to the slit portion 109C formed on the movable electrode 101.

With this constitution, the slit portion 109C can be inserted between the drive electrode 110 and the drive electrode 111. The corresponding area between the movable electrode 101 and the drive electrodes 110 and 111 can be increased due to the existence of the slit portion 109C which is easier on the manufacturing than the electromechanical switch of the fifth embodiment, thereby giving an electrostatic force required to expand the spring formed by the slit portion 109C. Also, it is possible to avoid contact between the slit portion 109C and the drive electrodes 110 and 111 and avoid occurrence of stiction.

Although the pulling method for pulling the movable electrode 101 with the drive electrodes 110 and 111 arranged at both sides of the intermediate bending portion 109 of the uneven structure is described above in this embodiment, the electromechanical switch of this embodiment can also increase an electrostatic force with the drive electrode 101 arranged at the one side to pull the movable electrode toward the one side, in the same way as shown in FIG. 6. When the movable electrode 101 is pulled in the reverse direction to the signal electrode 102 by the drive electrode 110, the contact point between the movable electrode 101 and the signal electrode 102 can be easily released by sliding the contact point.

In this way, with the electromechanical switch 800, it is possible to realize the electromechanical switch with high reliability that was conventionally difficult to realize, and an electrical machinery and apparatus using the electromechanical switch.

Seventh Embodiment

A driving method for the electromechanical switch of the invention will be described below in the following embodiments.

Figures 10A, 10B:
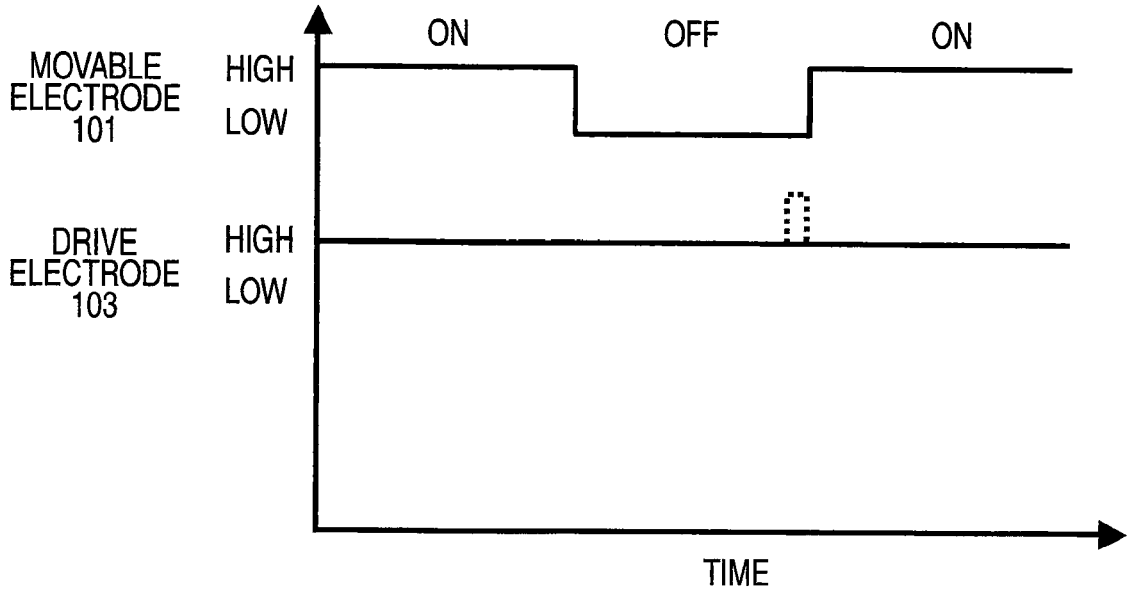
FIG. 10A is a table showing the control signals for an electromechanical switch according to a seventh embodiment of the invention.
FIG. 10B is a graph showing the control signals of the electromechanical switch.

FIG. 10A is a table showing a control signal for the electromechanical switch according to the embodiment of the invention, and FIG. 10B is a graph showing the control signal for the electromechanical switch. The driving method for the electromechanical switch of this embodiment is applicable to the electromechanical switch according to the above first to sixth embodiments, and particularly, the driving method is more appropriate for the electromechanical switch of the first and second embodiments.

FIGS. 10A and 10B show the control signals applied to the movable electrode 101 and the drive electrode 103 when the electromechanical switch is turned ON and OFF. When the electromagnetic switch is in OFF state, a potential is applied between the movable electrode and the drive electrode, while when the switch is in ON state, no potential is applied between the movable electrode and the drive electrode. When a plurality of drive electrodes are provided, the electromagnetic switch can be driven by the similar control signals.

With this constitution, the effect of higher reliability with the curvature structure or uneven structure can be achieved using the same simple control signals as the constitution without the curvature structure or uneven structure.

The potential of the drive electrode 101 may be increased immediately before turning ON the switch to apply a greater driving force between the movable electrode 101 and the drive electrode 103, and the contracting force may be increased by once expanding the spring of the intermediate bending portion 109 or the bending portion 108, as indicated by the broken line in FIG. 10B. This can be implemented by increasing the control signal of the drive electrode 103 instantaneously. The contact point between the movable electrode and the signal electrode can be released more easily.

Eighth Embodiment

Figures 11A, 11B:
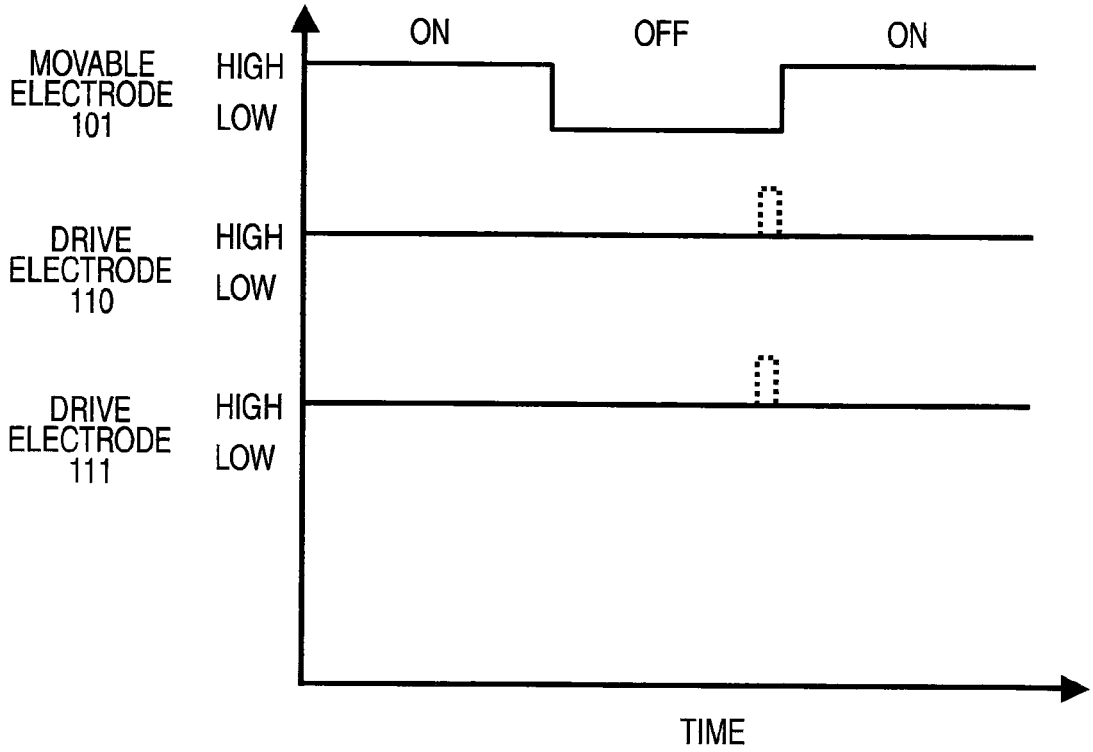
FIG. 11A is a table showing the control signals for an electromechanical switch according to a eight embodiment of the invention.
FIG. 11B is a graph showing the control signals for the electromechanical switch.

FIG. 11A is a table showing the control signals for the electromechanical switch according to the embodiment of the invention, and FIG. 11B is a graph showing the control signals for the electromechanical switch. Although one drive electrode is employed with the driving method for the electromechanical switch in the seventh embodiment, two drive electrodes are provided in this embodiment. The driving method for the electromechanical switch of this embodiment is applicable to the electromechanical switch according to the previous first to sixth embodiments, and more effective especially for the electromechanical switches of the third, fifth and sixth embodiments.

FIGS. 11A and 11B show the control signals applied to the movable electrode 101 and the drive electrodes 110 and 111 when the electromechanical switch is turned ON and OFF. When the switch is in OFF state, a potential is applied between the movable electrode 101 and the drive electrodes 110 and 111, while when the switch is in ON state, no potential is applied between the movable electrode 101 and the drive electrodes 110 and 111.

With this constitution, the effect of higher reliability with the curvature structure or uneven structure can be achieved using the similar simple control signals as the constitution without the curvature structure or uneven structure.

The potential of the drive electrodes 110 and 111 may be increased immediately before turning ON the switch to apply a greater driving force between the movable electrode 101 and the drive electrodes 110 and 111, and the contracting force may be increased by once expanding the spring of the intermediate bending portion 109 or the bending portion 108, as indicated by the broken line in FIG. 11B. This can be implemented by increasing the control signals of the drive electrodes 110 and 111 instantaneously. The contact point between the movable electrode and the signal electrode can be released more easily.

Although the pulling method for pulling the movable electrode with the drive electrodes 110 and 111 arranged at both sides of the intermediate bending portion 109 of the uneven structure is described above in this embodiment, it is possible to increase an electrostatic force with the drive electrode arranged at the one side to pull the movable electrode toward the one side. When the movable electrode is pulled in the reverse direction to the signal electrode 102 by the drive electrode 110, the contact point between the movable electrode 101 and the signal electrode 102 is can be easily released by sliding the contact point. The potential of the drive electrode 110 is increased immediately before turning ON the switch to apply a greater driving force between the movable electrode 101 and the drive electrode 110, and the contracting force is increased by once expanding the spring of the intermediate bending portion 109 or the bending portion 108 in a modification as shown in FIG. 12B. This can be implemented by increasing the control signal of the drive electrode 110 instantaneously. With this driving method, the contact point between the movable electrode and the signal electrode can be released easily.

In this way, with the control signals of the electromechanical switch, it is possible to realize the electromechanical switch with high reliability that was conventionally difficult to realize, and an electrical machinery and apparatus using the electromechanical switch.

Also, the electromechanical switch of the invention is applicable to not only an electric circuit for wireless communication but also various other electric circuits.

Also, the electromechanical switch of the invention is applicable to not only a wireless communication terminal but also other electronic equipment for various purposes.

The electromechanical element according to the invention is effective to produce the electromechanical element with high reliability and the electronic equipment provided with the electromechanical element.

What is claimed is:

1. An electromechanical element, comprising:

a first electrode which is provided on a substrate; and a second electrode and a plurality of third electrodes which are provided via a gap with respect to the first electrode, wherein the first electrode contacts with the second electrode when an attracting force is applied between the first electrode and each of the third electrodes;

wherein the first electrode has a bent portion which is a V shaped portion;

wherein the third electrodes are arranged with space therebetween;

wherein the V shaped portion is disposed at a position opposite to the space and protrudes toward the space between the third electrodes; and wherein the second electrode is not positioned between the third electrodes.

2. The electromechanical element according to claim 1, wherein the V shaped portion is provided in a part of the first electrode other than a front end of the first electrode.

3. The electromechanical element according to claim 1, wherein a contact point between the first electrode and the second electrode is displaced in a horizontal direction with respect to the substrate.

4. The electromechanical element according to claim 1, wherein the first electrode has a plurality of the bent portions.

5. The electromechanical element according to claim 1, wherein a plurality of the third electrodes are provided.

6. The electromechanical element according to claim 1, wherein the first electrode is expanded or contracted when the first electrode is separated from the second electrode.

7. An electronic equipment provided with the electromechanical element according to claim 1.

8. The electromechanical element according to claim 1, wherein an insulation film is formed on a surface of the first electrode opposed to the third electrode and a surface of the third electrode opposed to the first electrode.

9. A driving method of an electromechanical element including a first electrode which has a bent portion which is a V shaped portion and is provided on a substrate, and a second electrode and a plurality of third electrodes which are provided via a gap with respect to the first electrode, wherein the third electrodes are arranged with space therebetween, wherein the V shape portion is disposed at a position opposite to the space between the third electrodes and protrudes toward the space between the third electrodes, and wherein the second electrode is not positioned between the third electrodes, the driving method comprising:

contacting the first electrode with the second electrode by applying an attracting force between the first electrode and the third electrodes; and releasing a contact state of the first electrode with the second electrode by an expanding or contracting force of the bent portion of the first electrode.

10. The driving method according to claim 9, wherein in the contacting process, the first electrode is displaced on the second electrode at a contact position between the first electrode and the second electrode by an expanding or contracting force of the bent portion.

11. The driving method according to claim 9, wherein in the releasing process, the first electrode is displaced on the second electrode at a contact position between the first elec trode and the second electrode by an expanding or contracting force of the bent portion.

12. The driving method according to claim 9, wherein in the releasing process, an attracting force is instantaneously applied between the first electrode and the third electrode before the contact state of the first electrode with the second electrode is released.

13. The driving method according to claim 9, wherein in the releasing process, the contact state of the first electrode with the second electrode is released by a restoring force of the bent portion.

* * * * *